United States Patent [19]

Buske et al.

[11] 4,252,133

[45] Feb. 24, 1981

[54] VAPOR EXCHANGE

[75] Inventors: Walter E. Buske, Amesbury; Charles W. Hoyt, Belmont; Albert A. Thompson, Waltham, both of Mass.

[73] Assignee: Wolverine Corporation, Methuen, Mass.

[21] Appl. No.: 888,214

[22] Filed: Mar. 20, 1978

[51] Int. Cl.[3] ..... A24B 3/12

[52] U.S. Cl. ..... 131/136; 34/155; 68/5 D

[58] Field of Search ..... 131/133–137, 131/120, 140 R, 140 P; 68/5 E, 5 D; 34/151, 233, 232, 155

[56] References Cited

U.S. PATENT DOCUMENTS

| | | | |
|---|---|---|---|
| Re. 11,748 | 6/1899 | Proctor | 131/136 |
| Re. 20,932 | 11/1938 | Smith | 131/135 |
| 568,491 | 9/1896 | Proctor | 131/134 |
| 585,759 | 7/1897 | Hysore | 131/134 |
| 616,292 | 12/1898 | Davidson | 131/136 |
| 655,513 | 8/1900 | Proctor | 131/136 |
| 1,789,435 | 1/1931 | Hawkins | 131/134 |
| 2,002,120 | 5/1935 | Maxwell | 131/136 |
| 2,016,535 | 10/1935 | Bogaty | 131/133 R |
| 2,229,546 | 1/1941 | Bogaty | 131/140 R |
| 2,418,281 | 4/1947 | Touton | 131/136 |
| 2,900,986 | 8/1954 | Pietruska | 131/134 |
| 3,280,825 | 10/1966 | Rosing | 131/136 |
| 3,503,231 | 3/1970 | Fleissner et al. | 68/5 E |
| 3,670,425 | 6/1972 | Benjamin et al. | 34/151 |
| 3,799,176 | 3/1974 | Wochnowski | 131/135 |
| 3,877,469 | 4/1975 | Wochnowski et al. | 131/136 |
| 4,004,594 | 1/1977 | Wochnowski et al. | 131/135 |
| 4,091,824 | 5/1978 | Psaras | 131/135 |

*Primary Examiner*—V. Millin

[57] ABSTRACT

Material to be treated is transported through a treatment zone bounded by a foraminous member that separates the treatment zone from an immediately adjacent zone of high density vapor. The vapor is flowed through the foraminous member and directly into the material at a continuous rate and with a major portion of the vapor flowed from the vapor zone being entrained by the material in the treatment zone. The continuous moderate flow of vapor into the bed of material produces rapid vapor transfer and with excellent distribution of the vapor within the material being treated.

16 Claims, 5 Drawing Figures

FIG 4
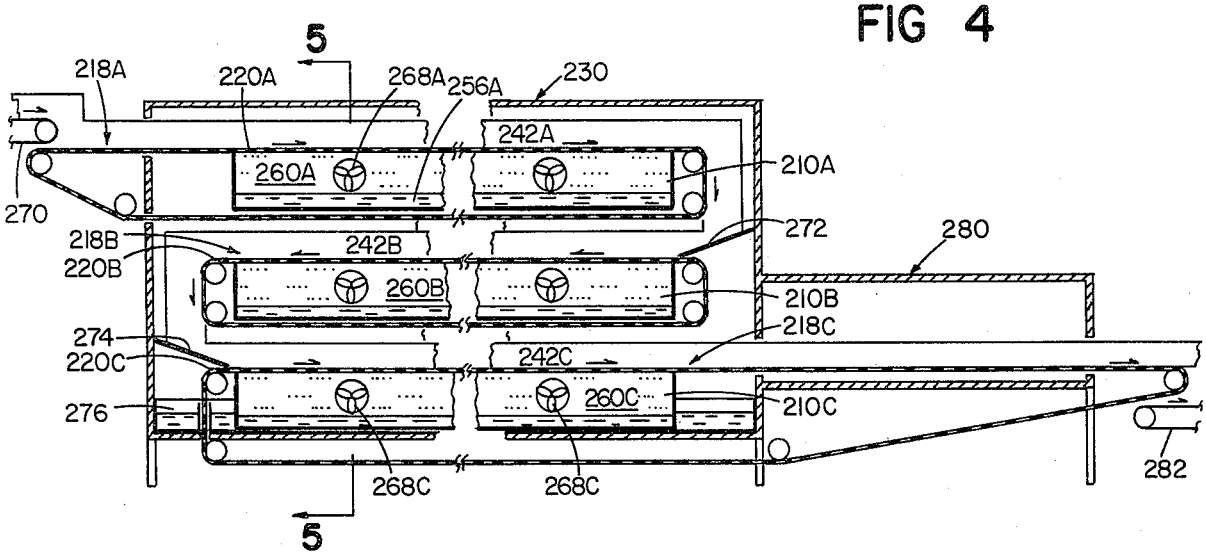
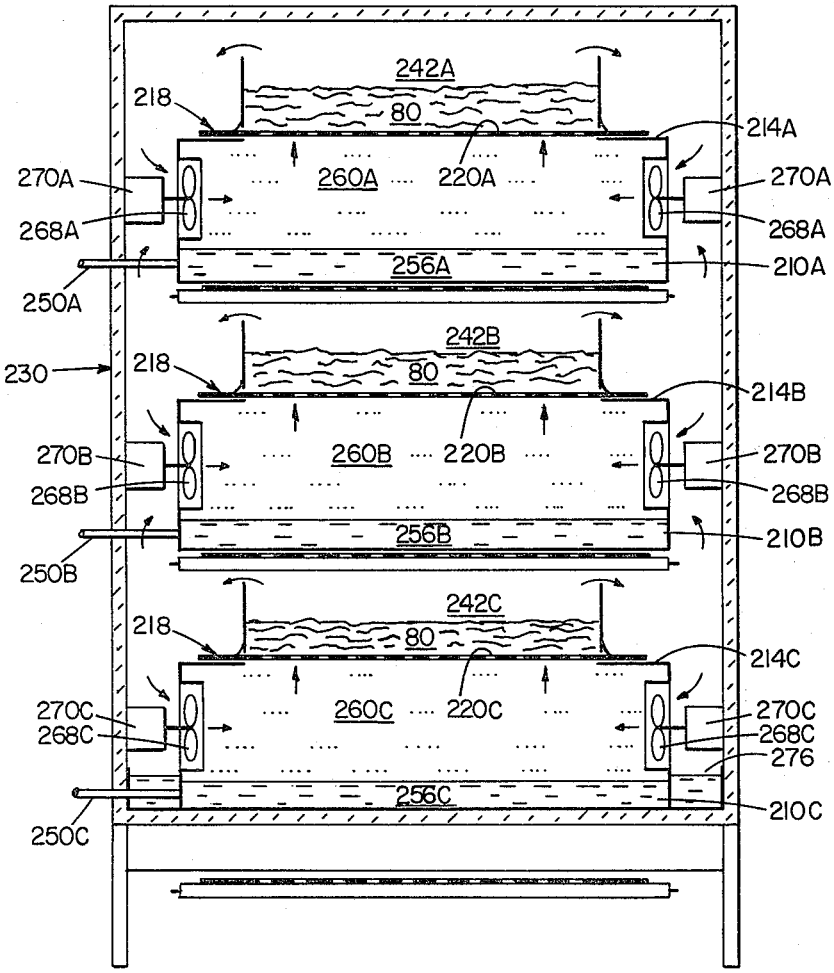
FIG 5

VAPOR EXCHANGE

This invention relates to material treatment and more particularly to vapor exchange processes and apparatus for treating materials such as tobacco or the like.

Tobacco, during processing, is commonly subjected to one or more treatment steps that utilize a gaseous fluid.

For example, among the treatment steps to which tobacco may be exposed in a processing sequence to an atomized liquid (casing) which penetrates into the fiber structure of the tobacco; to a heated gas in a "roasting" process; to a cool gas to cool the roasted tobacco; and to moist sprays to increase the moisture content of the roasted and cooled tobacco as substantial moisture content is desirable for suitable suppleness of pliability of the tobacco and to reduce the likelihood of tobacco dust generation and/or excessive fragmentizing of tobacco during processing. Freshly gathered tobacco is normally dried for storage and it is frequently desirable to increase the moisture content of such dried tobacco prior to processing. It is also desirable that the moisture content of tobacco particles which are to be introduced into a modern high speed cigarette making machine be maintained within close tolerances. Similar adjustment of desired moisture content of other hygroscopic materials such as cereal flakes and vapor impregnation treatments of solid materials are also frequently desired.

Numerous processes and apparatus for adjusting the moisture content of hygroscopic materials have been proposed and used. Perhaps most frequently used is a stream of air into which steam or hot water is sprayed. The air stream in some systems flows in the direction concurrent with the transport direction, in other systems flows in a countercurrent direction, and in still other systems flows upwardly through a bed of material (such as tobacco) for "fluidizing" the material. Among the problems encountered is the tendency for the water vapor to condense from the air stream which results in formation of stains on the tobacco and in nonuniform distribution of moisture content through the tobacco. In practice the reordering of tobacco with a high degree of uniformity at commercially acceptable rates has been difficult.

The present invention provides novel and improved processes and apparatus for providing vapor exchange treatment of tobacco and other materials. In accordance with an aspect of the invention, the material to be treated is transported through a treatment zone that is bounded by a foraminous member that separates the treatment zone from an immediately adjacent zone of high density vapor. The vapor is flowed through the foraminous member and directly into the material at a continous rate and with a major portion of the vapor flowed from the vapor zone being entrained by the material in the treatment zone. The continuous moderate flow of vapor into the bed of material produces rapid vapor transfer (without such problem as staining due to partial condensation) and with excellent distribution of the vapor within the material being treated.

Preferably the treatment zone is immediately above the vapor zone so that vapor rises through the foraminous member for flow into the material in the treatment zone. The vapor flow is preferably maintained by creating a positive pressure in the range of about 0.1–1.0 inch of water in the vapor zone with a gas flow in a closed circulation path for consideration such as containment, efficiency and energy conservation. Preferably vapor is derived from warm liquid in a chamber immediately adjacent the treatment zone, the heat and flow conditions being such that the vapor zone is essentially fully saturated at the temperature of the liquid in the chamber. Various foraminous members may be used including open mesh walls or tube arrays. The vapor exchange may be carried out in a single treatment sequence or series of treatment stages. Either or both the vapor exchange rate and the ultimate vapor content of the material being treated may be controlled by suitable means as by adjusting the transport rate of material or the vapor flow rate or other parameters.

In particular embodiments, tobacco reordering apparatus comprises an open top vapor chamber and a porous conveyor of the endless belt type of less than ten percent open area which conveys the tobacco through the treatment zone that is immediately above the vapor chamber. The belt conveyor seats on and encloses the top of the chamber. Water in the chamber is heated to provide an essentially saturated vapor zone immediately below the belt and the chamber is pressurized so that vapor flows upwardly through the pores in the belt in rapid and uniform moisturizing of the tobacco. Supplemental downwardly directed gas flows may be used to provide a stabilizing influence on material such as bone dry tobacco and also to provide supplemental transport gas in the zone immediately above the material being processed.

Other features and advantages of the invention will be seen as the following description of particular embodiments progresses, in conjunction with the drawings, in which:

FIG. 4 is a diagrammatic cross-sectional view of still another embodiment; and

FIG. 5 is a cross-sectional view taken along the line 5—5 of FIG. 4.

DESCRIPTION OF PARTICULAR EMBODIMENTS

Figure 1:
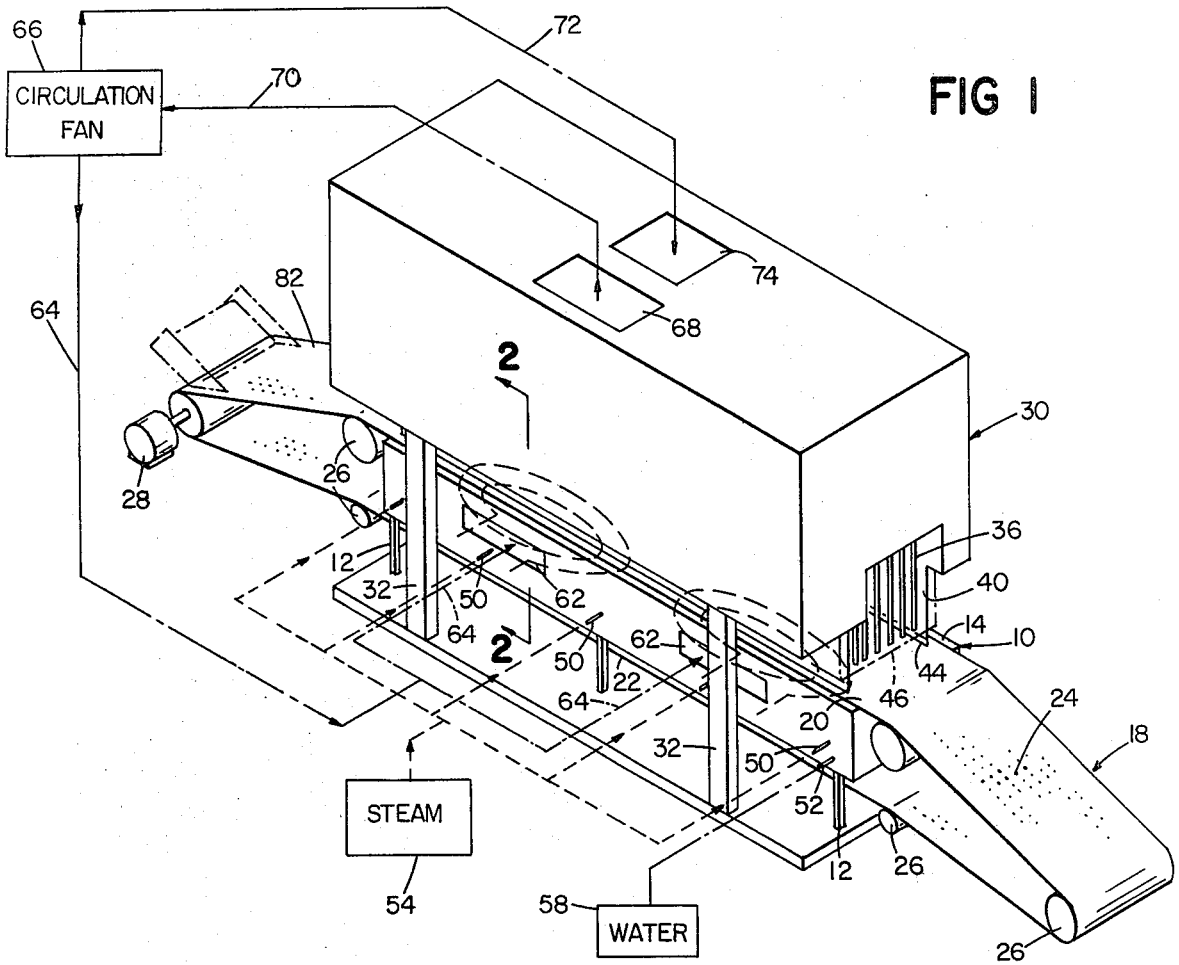
FIG. 1 is a perspective view of tobacco processing apparatus in accordance with the invention.

The apparatus shown in FIG. 1 includes stainless steel chamber structure 10 that is about thirty inches wide, about one hundred thirty inches long, and about sixteen inches deep. Chamber 10 is mounted on supports 12. The top wall 14 of chamber 10 defines an elongated opening 16 (see FIG. 2) that is about twenty inches in width and about one hundred twenty inches in length.

Food grade endless belt conveyor 18 has upper run 20 that is seated on chamber top surface 14 and extends across opening 16 and a lower run 22. Belt 18 has a matrix of apertures 24 spaced about 1½ inch on center across the width and along the length of belt 18. The size and spacing of apertures 24 determine the percent open area of the belt. The belt is supported by conventional support rolls 26 and driven by conventional means diagrammatically indicated at 28.

Disposed above chamber 10 and belt 18 is an insulated housing structure 30 mounted on supports 32. That housing structure includes an elongated plenum 34 (FIG. 2) in its upper section from which depends an array of elongated tubes 36 that extend downwardly towards conveyor 20. Apparatus of this general type is shown in U.S. Pat. Nos. 3,060,590 and 3,229,377. Extending along either side of the array of tubes 36 is a wall member 40 about one hundred twenty inches in length. Wall members 40 are spaced about eighteen inches apart and define the side boundaries of a treatment zone 42, the base of which is defined by the upper run 20 of foraminous conveyor 18. The cross-sectional area of the passages defined by tubes 36 is about two percent of the cross-sectional area of the treatment zone 42, the tubes being arranged in transverse rows along the length of the treatment zone. Flexible wiping seals 44, carried by each wall 40 at its lower edge, engage the margins of conveyor run 20 and provide seals along the sides of the treatment zone 42. A flexible curtain 46 at each end of housing 30 defines an end boundary of the treatment zone 42.

Connected to chamber 10 are five steam lines 50. Each steam line connection is spaced about four inches from the bottom of chamber 10. Water is supplied to the chamber over lines 52 and maintained at a level of about six inches. Lines 50 are connected to a source 54 of steam, and the flow of steam into the water 56 (FIG. 2) creates high density vapor in zone 60 within chamber 10 above water 56 and immediately below foraminous conveyor run 20 that forms the upper bounding wall of chamber 10. Alternative or supplemental heating means may be used as desired. For example, it may be advantageous to provide supplemental heating coils within chamber 10 (as diagrammatically indicated in FIG. 1), and to control the density of vapor in zone 60 by controlling the heat input. In the side walls of the chamber 10 are ports 62 which are connected over lines 64 to circulation fan 66. Fan 66 receives air from discharge port 68 in the upper wall of housing 30 over line 70 and circulates air over lines 64 to ports 62 and over line 72 to plenum inlet port 74.

Figure 2:
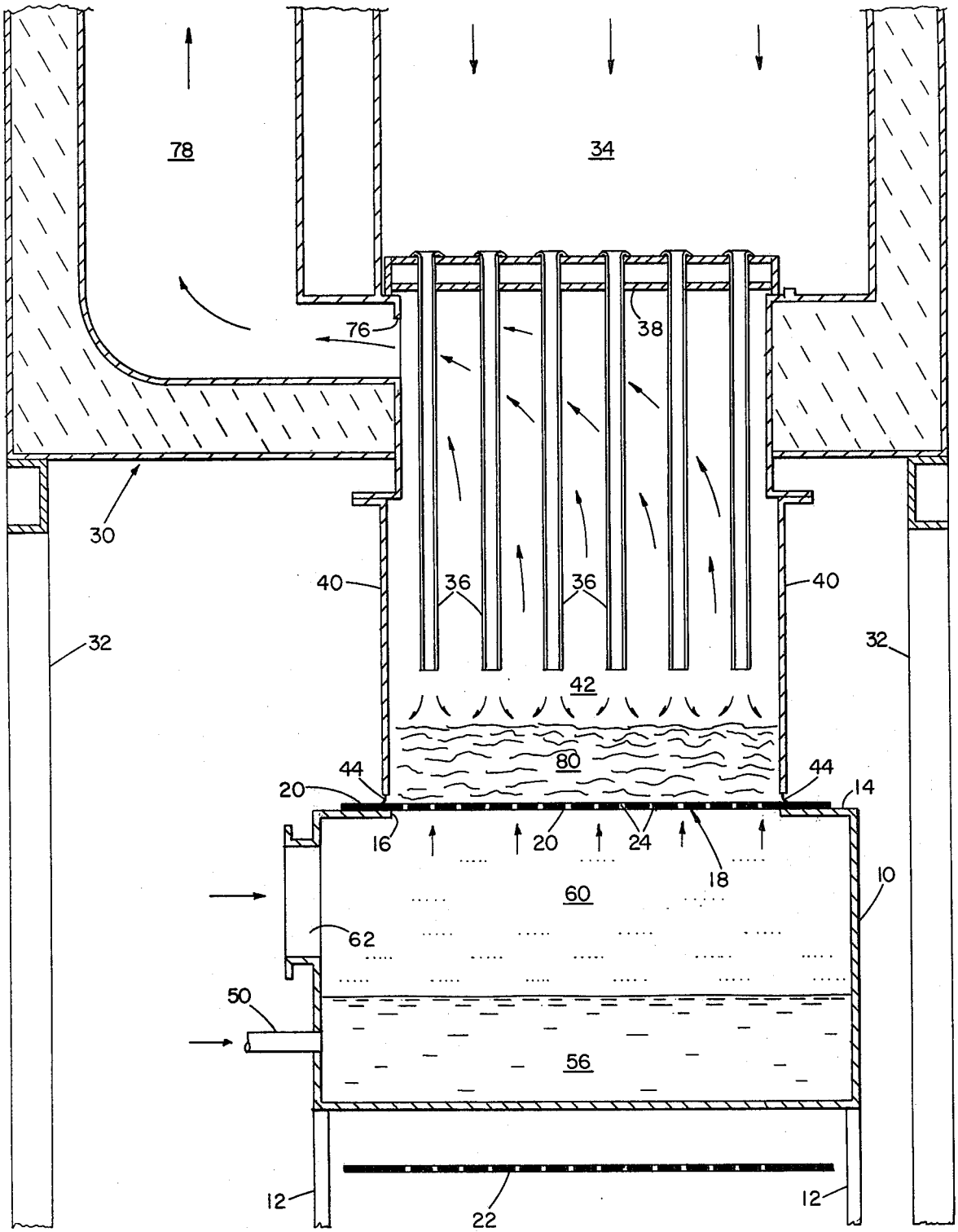
FIG. 2 is a cross-sectional view taken along the line 2—2 of FIG. 1.

Further aspects of the system may be seen with reference to FIG. 2. The upper run 20 of conveyor 18 provides a foraminous member between vapor zone 60 in lower chamber 10 and treatment zone 42 in the upper chamber. Vapor zone 60 is pressurized by air flowing into ports 62 to create a gentle and continuous flow of water vapor up into the tobacco 80 on conveyor run 20. A supplemental air flow from tubes 36 is directed downwardly against the upper surface of the bed of tobacco 80. The gases are exhausted upwardly from the treatment zone through exhaust ports 76 that extend along the length of a side wall 40 and through riser 78 to discharge port 68. The air flow passages 62, 64, 72, and 74 are sized so that approximately equal amounts of air are distributed from circulation fan 66 to the upper plenum 34 and to the vapor zone 60 in chamber 10, fan 66 pressurizing the air to establish a positive pressure within vapor zone 60.

In operation, the tobacco 80 to be moisturized is continuously fed in conventional manner onto the input apron 82 of conveyor 18 and formed into a bed of generally uniform depth. Conveyor run 20 transports this bed of tobacco through the conditioning zone 42 at a constant rate where the bed of tobacco is exposed to upward flow of vapor from chamber 10 and concurrent downward flow of air from passages 36. The tobacco being processed in the conditioning zone 42 absorbs moisture rapidly and with excellent uniformity. In a typical sequence, both the conditioned tobacco discharged from zone 42 and the belt 18 are at a temperature of about 130° F. The tobacco is then cooled to ambient temperature without extracting significant amounts of moisture.

As an example, the moisture content of uncased cut leaf tobacco was increased from 1% to 24% in a single pass of nine minutes duration in apparatus as described above employing a transport belt 18 of about 2% open area. The uniformity of moisture content of the reordered tobacco was excellent.

In a typical sequence of processing Burley tobacco, the tobacco was dried by heating, which process simultaneously reduces the moisture content of the tobacco. The dried tobacco is cooled and then reordered by raising its moisture content to the desired condition for further processing of the tobacco. In a sequence of processing cased Burley strip, the moisture content of the cased tobacco was first reduced from about forty percent to about eight percent in a drying sequence and then increased to about eighteen percent in a reordering interval of about 2½ minutes with apparatus as described above. Belt 18 had an open area of about four percent and the water 56 in chamber 10 was heated both by steam injected through conduits 50 and by steam flowing through supplemental coils in the tank. The uniformity of moisture content through the reordered tobacco was excellent.

Other examples of processing tobacco with the apparatus shown in FIGS. 1 and 2 are indicated in the following table:

| Tobacco Type | Cased | Cased | Uncased Blended Burley Strip | Uncased Blended Burley Strip | Uncased Blended Burley Strip |
|---|---|---|---|---|---|
| Depth of Bed 80 (Inches) | 4 | 4 | 4 | 4.5 | 3.5 |
| Temp. of Water 56 (°F.) | 150 | 150 | 152 | 170 | 150 |
| Open Area of Belt 18 (%) | 8 | 8 | 8 | 8 | 8 |
| Treatment Time (minutes) | 5 | 7.5 | 7.5 | 4.8 | 5 |
| Tobacco Moisture (% wet basis) | | | | | |
| -IN | 0 | 0 | 0 | 0 | 0 |
| -OUT | 12.8 | 19 | 18 | 13 | 12.7 |
| Pressure—Plenum 34 (inches of water) | .55 | .6 | .6 | .5* | 1.0* |
| Pressure—Chamber 10 | .65 | .9 | .8 | .8 | .25 |

-continued

| Tobacco Type | Cased | Cased | Uncased Blended Burley Strip | Uncased Blended Burley Strip | Uncased Blended Burley Strip |
|---|---|---|---|---|---|
| (inches of water) | | | | | |

*supplemental water vapor introduced into line 72

Vapor zone 60 is at approximately the same temperature as water 56 and is essentially saturated, the dry and wet bulb temperatures being substantially equal.

In those reordering sequences, both the conditioned tobacco and the upper run 20 of belt 18 are at a temperature of about 130° F. at the outlet end of the apparatus.

In a multiple pass reordering sequence with the apparatus shown in FIGS. 1 and 2, the moisture content of bone dry (0% moisture) tobacco was increased to thirty-five percent in four passes. In that sequence a two inch depth of bed 80 was employed, a water temperature of 150° F., a chamber pressure of ¼ inch of water and no air flow through plenum 34. The moisture content of the tobacco after the first pass was fifteen percent, after the second pass twenty-five percent, after the third pass twenty-nine percent, and after the fourth pass thirty-five percent.

Figure 3:
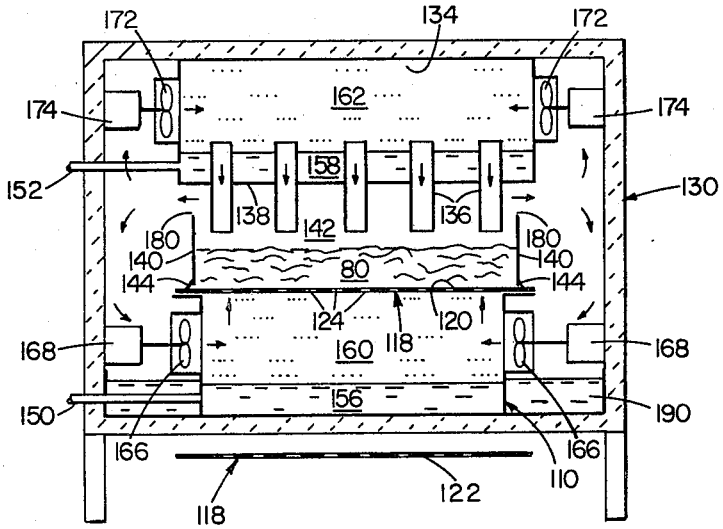
FIG. 3 is a diagrammatic cross-sectional view of another embodiment of processing apparatus in accordance with the invention.

Another embodiment is shown in FIG. 3. That embodiment includes an insulated housing 130 having a chamber 110 at the base of housing 130 and an upper plenum 134 with an array of elongated tubes 136 that extend through the lower wall 138 of plenum chamber 134. Endless belt conveyor 118 has an upper run 120 that forms a foraminous boundary wall to chamber 110 and a lower run 122. The treatment zone 142 is defined by upper conveyor run 120 and side walls 140. Flexible wiping seals 144, carried by each wall 140 at its lower edge, engage the margins of conveyor run 120 and provide seals along the sides of treatment zone 142. A body of water 156 is in chamber 110 and a similar body of water 158 is in plenum chamber 134. Heat is supplied to each body of water over steam lines 150, 152 or by other suitable means so that a zone 160 of high density vapor is created above water 156 immediately adjacent foraminous member 120, and a similar vapor zone 162 is created above water 158 in plenum chamber 134 adjacent the upper ends of tubes 136 which provide a foraminus boundary between chamber 134 and treatment zone 142. Fans 166, spaced along the length of side walls of chamber 110 are driven by motors 168 and similar fans 172 driven by motors 174 are provided in the side walls of supply plenum 134. The resulting air flow pressurizes the two vapor zones 160, 162 to create gentle and continuous flows of water vapor through foraminous structures 120, 136 for efficient vapor exchange with tobacco 80 in treatment zone 142, the gases from treatment zone 142 being exhausted through ports 180 at the upper ends of side walls 140 for closed path recirculation within insulated housing 130 to the lower and upper sets of fans 166, 172. Condensate flows to sump 190 and condensate and make up water is circulated (with filtering if appropriated) to maintain proper water levels in chambers 110, 134.

Still another embodiment is shown in FIGS. 4 and 5. In that embodiment, three elongated tanks 210A, 210B, and 210C are provided within insulated housing 230. Associated with each tank is a conveyor 218 which has an upper run 220 that is seated on upper tank walls 214. Supplemental support bars (not shown) extend between tank wall members 214 to provide supplemental belt support. Each tank 210 contains a body of water 256 that is heated appropriately as by steam lines 250 to provide a high density vapor zone 260 in the chamber between the water 256 and the foraminous boundary 220. Fans 268 in the tank side walls (driven by motors 270) circulate air within housing 230 into the vapor zones 260. Associated with each tank 210 is a treatment zone 242, the base of which is defined by foraminous upper conveyor run 220 and the sides of which are defined by walls 240 which carry appropriate seals 244 that engage the margins of conveyor run 220.

With reference to FIG. 4, tobacco 80 to be treated is supplied on the conveyor 270 to conveyor 218A for transport through treatment zone 242A. At the end of transport treatment zone 242A tobacco is transferred via guide plate 272 to transport conveyor 218B for passage through treatment zone 242B and then similarly transferred by means of guide plate 274 to transport conveyor 218C for passage through treatment zone 242C. Throughout this operation, fans 268 pressurize the high density vapor zones 260 to create continuous flows of water vapor up into the tobacco beds in the treatment zones with gases being exhausted upwardly over the tops of side walls 240 of the treatment zone for recirculation as indicated by the arrows. Condensate flows down the insulated walls of housing 230 to sump 276. The condensate water may be recirculated after filtering if necessary and supplied as makeup water to the bodies of water 256 in chambers 210. Conveyor 218C extends through an evaporative cooler diagrammatically indicated at 280 for cooling the reordered tobacco which is then transferred to output conveyor 282.

In a particular embodiment each treatment zone has a width of about four feet and a length of about thirty feet. Belts 218 have four percent open area. Chambers 210 have a width of sixty inches and a height of twenty inches and water 256 is maintained within chambers 210 at a depth of about three inches. The evaporative cooler unit 280 has a length of about ten feet.

The invention provides particularly effective tobacco reordering processes and apparatus. The high density vapor zone in close proximity to the bed of tobacco and the gentle continuous flow of vapor into the tobacco bed efficiently, rapidly and economically reorders tobacco to moisture percentages of twenty percent and above without damage to the fragile tobacco leaf material.

Various modifications will be apparent. For example, aromatics or flavorings may be included in aqueous solution in the vapor chamber. Liquids other than water may be used for vapor impregnation treatments or the like. Various material conveying mechanisms may be employed in other particular embodiments. Specific parameters such as the aperture size and the foraminous structure porosity may be varied depending on the specific material being processed. Therefore, while particular embodiments of the invention have been shown and described, it is not intended that the invention be limited to the disclosed embodiments or to details thereof and departures may be made therefrom within the spirit and scope of the invention.

What is claimed is:

1. A vapor exchange process for tobacco and the like comprising the steps of:

providing a treatment zone and an adjacent chamber separated from said treatment zone by foraminous structure, providing a body of liquid in said chamber, creating a zone of high vapor density in said chamber above said body of liquid and immediately adjacent said foraminous structure, conveying the material to be processed through said treatment zone past said foraminous structure, and flowing vapor from said chamber through said foraminous structure into said treatment zone during conveyance of material through said treatment zone so that at least a major portion of the vapor flowed from said chamber through said foraminous structure is entrained by said material as it is transported through said treatment zone.

2. A process according to claim 1 wherein a pressure differential across said foraminous structure is created by circulation of gas in a closed path to flow said vapor through said foraminous structure.

3. A process according to claim 2 wherein the pressure differential is in the range of 0.1–1.0 inch of water.

4. A process according to claim 1 wherein said body of liquid is heated to create said zone of high vapor density and the vapor density in said vapor zone being in excess of eighty percent saturation at the water temperature of said liquid.

5. A process according to claim 1 wherein said treatment zone is immediately above said chamber and material to be processed is conveyed in bed form through said treatment zone.

6. A process according to claim 5 wherein the material to be treated is tobacco supported on said foraminous structure and further including the steps of moving said foraminous stucture relative to said chamber to transport material through said treatment zone.

7. A tobacco reordering process according to claim 6 wherein said liquid is water and is heated to create essentially complete vapor saturation at the water temperature immediately below said foraminous structure, and flow of water vapor through said foraminous structure is produced by circulation of gas in a closed path to create a pressure differential in the range of 0.1–1.0 inch of water across said movable foraminous structure.

8. Tobacco reordering apparatus comprising chamber stucture for containing a body of water, vapor creating means including means for heating said water to create essentially complete vapor saturation at the temperature of the water in said chamber for creating a zone of high vapor density within said chamber structure, a treatment zone directly above said vapor zone, a conveyor of the endless belt type that has a plurality of apertures, each said aperture having a predetermined diameter and the combined cross-sectional area of said apertures constituting less than one tenth of the tobacco supporting area of said conveyor belt, and gas circulation means for creating a pressure differential in the range of 0.1–1.0 inch of water within said chamber structure to flow water vapor through said belt conveyor into tobacco in said treatment zone.

9. Vapor exchange apparatus comprising chamber structure for containing a liquid, means for creating a zone of high vapor density within said chamber structure, a treatment zone immediately adjacent said vapor zone, foraminous structure between said treatment zone and said vapor zone, said foraminous structure having less than 10 percent open area, and means for creating a pressure differential in the range of 0.1–1.0 inch of water within said chamber structure to flow vapor from said vapor zone through said foraminous structure for vapor exchange with material being transported through said treatment zone.

10. Apparatus according to claim 9 wherein said chamber structure has an open top with conveyor support structure extending along opposite sides of said open top, said foraminous structure is a conveyor for transporting material through said treatment zone, said treatment zone includes side wall structure along either side thereof with material retention structure at the base of each side wall and cooperating with said conveyor for retaining material being transported through said treatment zone on said conveyor.

11. Apparatus according to either claim 9 or 8 and further including a gas flow system for flowing gas downwardly against material in said treatment zone.

12. Vapor exchange apparatus comprising chamber structure for containing a liquid, means for creating a zone of high vapor density within said chamber structure, a treatment zone directly above said vapor zone, foraminous structure between said treatment zone and said vapor zone, means for flowing vapor from said vapor zone through said foraminous structure for vapor exchange with material being transported through said treatment zone, a gas flow system for flowing gas downwardly against material in said treatment zone, said gas flow system including a supply plenum above said treatment zone, an array of tubes extending along the length of said treatment zone and across the width of said treatment zone and arranged for flowing gas from said supply plenum downwardly towards said treatment zone, and means for exhausting gas from said treatment zone upwardly away from said foraminous structure.

13. The apparatus according to claim 12 wherein said supply plenum is arranged for containing a body of water and further including means for creating a zone of high density water vapor within said supply plenum, so that water vapor is flowed downwardly against material in said treatment zone.

14. Apparatus according to either claim 12 or 8 and further including an insulated housing in which said chamber structure and said treatment zone are disposed.

15. Apparatus according to claim 14 wherein said vapor creating means includes means for heating liquid.

16. Apparatus according to claim 14 wherein said vapor density in said chamber is at least eighty percent saturation at the temperature of the liquid in said chamber structure.

* * * * *

UNITED STATES PATENT AND TRADEMARK OFFICE

CERTIFICATE OF CORRECTION

PATENT NO. : 4,252,133

DATED : February 24, 1981

INVENTOR(S) : Walter E. Buske, et al.

It is certified that error appears in the above-identified patent and that said Letters Patent are hereby corrected as shown below:

Column 1, line 17, "suppleness of" should be --suppleness or--.

Column 4, line 44, "content through" should be --content throughout--.

Signed and Sealed this

*Thirtieth* Day of *June 1981*

[SEAL]

*Attest:*

RENE D. TEGTMEYER

*Attesting Officer*

*Acting Commissioner of Patents and Trademarks*